United States Patent [19]

Tuell et al.

[11] 4,294,456

[45] Oct. 13, 1981

[54] PIVOTABLE BALL SKATE

[75] Inventors: James L. Tuell; Paul Wahnschaff, both of Atlanta, Ga.

[73] Assignee: Tuell Industries, Inc., Atlanta, Ga.

[21] Appl. No.: 93,746

[22] Filed: Nov. 13, 1979

[51] Int. Cl.[3] ..... A63C 17/02; A63C 17/24

[52] U.S. Cl. ..... 280/11.28; 280/11.23

[58] Field of Search ..... 280/11.27, 11.19, 11.28, 280/11.26, 11.23, 11.22, 11.1 R, 7.13, 87.04 A, 87.04 R, 11.25

[56] References Cited

U.S. PATENT DOCUMENTS

| | | | |
|---|---|---|---|
| 862,431 | 8/1907 | Armband | 280/11.1 BR |
| 904,088 | 11/1908 | Rother | 280/11.1 BR |
| 2,095,942 | 10/1937 | Wetterstrand | 280/7.13 |
| 2,166,767 | 7/1939 | Petermann | 280/11.22 |
| 3,023,022 | 2/1962 | Boyden | 280/11.19 X |
| 3,993,318 | 11/1976 | Rothmayer | 280/7.13 X |
| 4,134,598 | 1/1979 | Urisaka | 280/7.13 X |
| 4,150,838 | 4/1979 | Lappage | 280/11.1 BR X |
| 4,153,263 | 5/1979 | Yoshimoto | 280/11.1 BR |

FOREIGN PATENT DOCUMENTS

| | | | |
|---|---|---|---|
| 211859 | 1/1941 | Switzerland | 280/11.25 |
| 541 | of 1875 | United Kingdom | 280/11.28 |

*Primary Examiner*—Joseph F. Peters, Jr.
*Assistant Examiner*—Milton L. Smith
*Attorney, Agent, or Firm*—Jones, Thomas & Askew

[57] ABSTRACT

A foot-mounted roller skate includes front and rear roller assemblies pivotable about upright axes. The rollers are hemispherical in shape and resilient pads are positioned on opposite sides of the roller support brackets to restrain the pivoting of the rollers out of alignment with the foot support platform.

5 Claims, 5 Drawing Figures

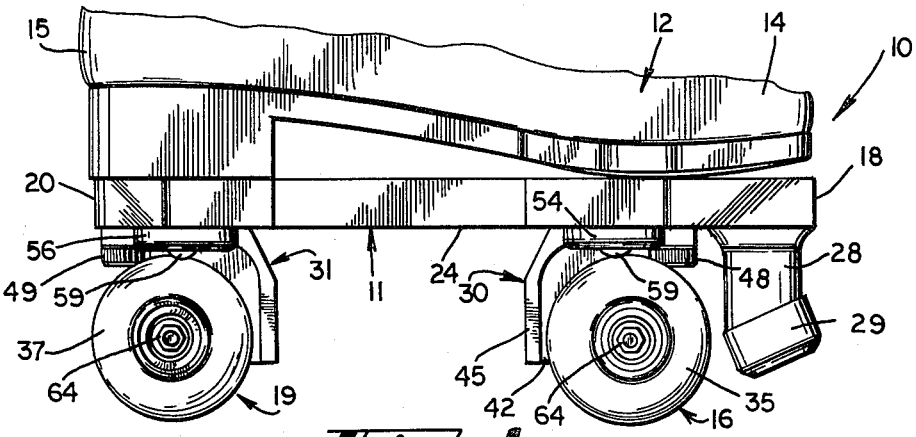
Fig. 1
Fig. 4
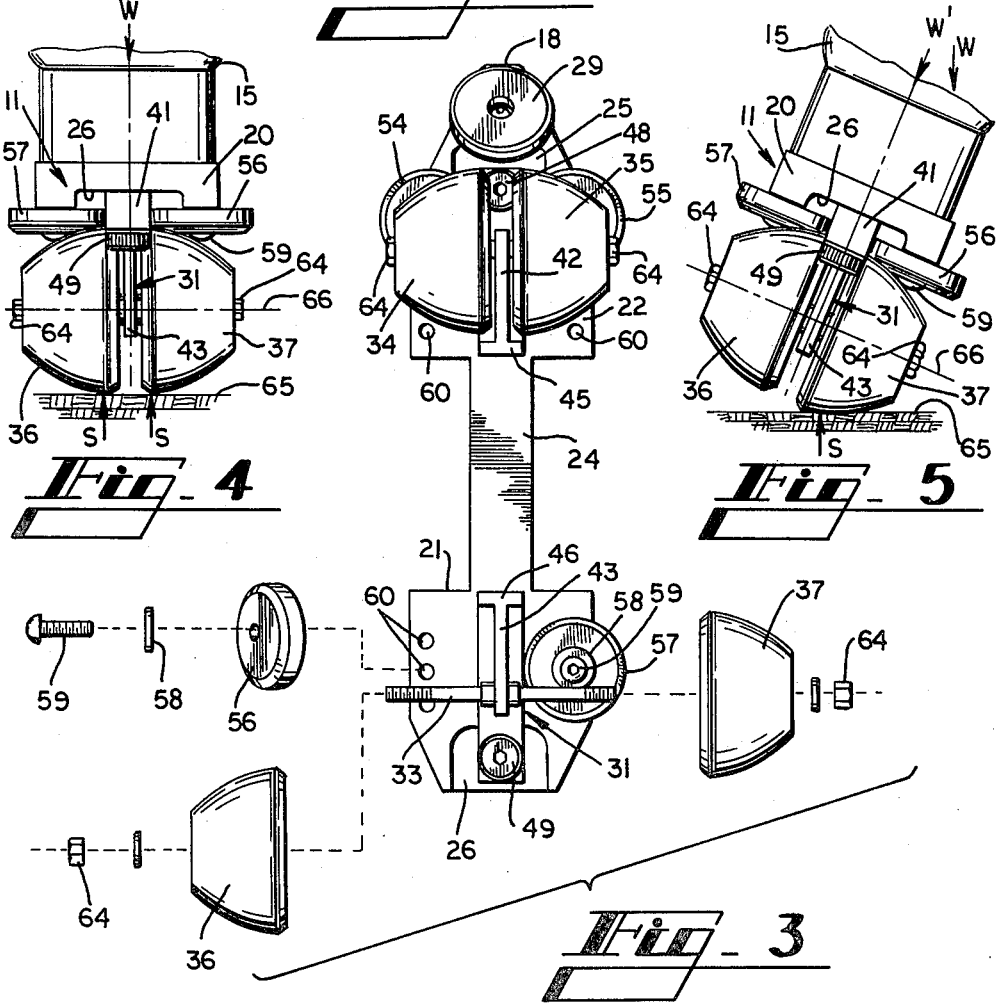
Fig. 3
Fig. 5

PIVOTABLE BALL SKATE

FIELD OF THE INVENTION

This invention relates to roller skates of the type that have pairs of hemispherical rollers in back-to-back relationship at the front and rear ends of a foot support platform, with the pairs of rollers being pivotable about an upright axis.

BACKGROUND OF INVENTION

Various roller skate assemblies have been manufactured and used in the past which have pairs of wheels mounted fore and aft on a foot support platform. In most instances, the front wheel support structure has been formed so that the front wheels can pivot to cause a change of direction of movement of the skate. The pivoting of the front wheels usually is caused by a rotation of the wearer's foot so as to tilt the foot support platform about its longitudinal axis. The degree of rotation of the front wheels away from their alignment with the length of the foot support platform depended, primarily, upon the degree of tilt of the foot as opposed to the amount of weight applied to the wheels in combination with the tilt, and once the front wheel structure of the prior art skates was fabricated the pivoting effect of the front wheels of the skate could not be varied by the wearer, as by adjusting some of the components of the skate. As a result, the wearer was required to depend entirely upon the manner in which the skate was manufactured for the performance characteristics provided by the skate.

In recent years roller skates have been fabricated with pairs of hemispherical rollers mounted in back-to-back relationship at the front and rear portions of the skate so that the wearer is able to tilt or roll his foot from one side to the other as when leaning into a turn when skating. The split hemispherical rollers thus similated an ice skating sensation for the skater. While the split hemispherical rollers represent an improvement over the earlier prior art wheels, a successful combination of a pivotable wheel skate and hemispherical split wheel skate has never been provided, wherein the skater can both lean into his turn and have his skate gradually change direction with him by having the front rollers pivot into the turn. Also, the prior art does not appear to disclose a roller skate that has a practical adjustment feature that permits the skater to vary the pivoting of the front wheels of the skate, so that with one adjustment the skater can make a tight turn with his skates by tilting his feet, and with another adjustment the skater can make a more shallow turn with the same tilt of his feet.

SUMMARY OF THE INVENTION

Briefly described, the present invention comprises a pivotable split-ball skate that includes pairs of hemispherical rollers mounted on the front and on the rear of a foot support platform, with the pairs of rollers each being supported on a bracket and with the brackets being pivotally mounted to the bottom surface of the foot support platform. Resilient pads are located on opposite sides of the bracket and are longitudinally offset from the pivot connector so that while the bracket and rollers can be pivoted with respect to the foot support platform, the pivoting of the bracket and rollers is limited in accordance with the position and resilience of the pads. The pads are connectable to the foot support platform at various positions along the length of the foot support platform so that the resistance to the pivoting movement of the rollers and support bracket can be varied in accordance with the desires of the skater.

Thus, it is an object of this invention to provide a pivotable ball skate wherein pairs of hemispherical rollers are positioned in back-to-back relationship both at the front and rear portions of a foot support platform, and at least the front rollers are pivotable with respect to the foot support platform to permit the skater to vary his direction of movement by tilting his feet from one side to the other.

Another object of this invention is to provide a skate assembly which is inexpense to construct, durable, adjustable and which provides the skater with a desirable combination of ruggedness and maneuverability.

Other objects, features, and advantages of the present invention will become apparent upon reading the following specification, when taken in conjunction with the accompanying drawings.

BRIEF DESCRIPTION OF THE DRAWINGS

FIG. 1 is a side elevational view of the pivotable ball skate.

FIG. 3 is a bottom exploded view of the pivotable ball skate.

FIG. 4 is a rear view of the skate in an upright attitude.

FIG. 5 is a rear view of the skate, showing the skate in a tilted attitude.

DETAILED DESCRIPTION

Figure 2:
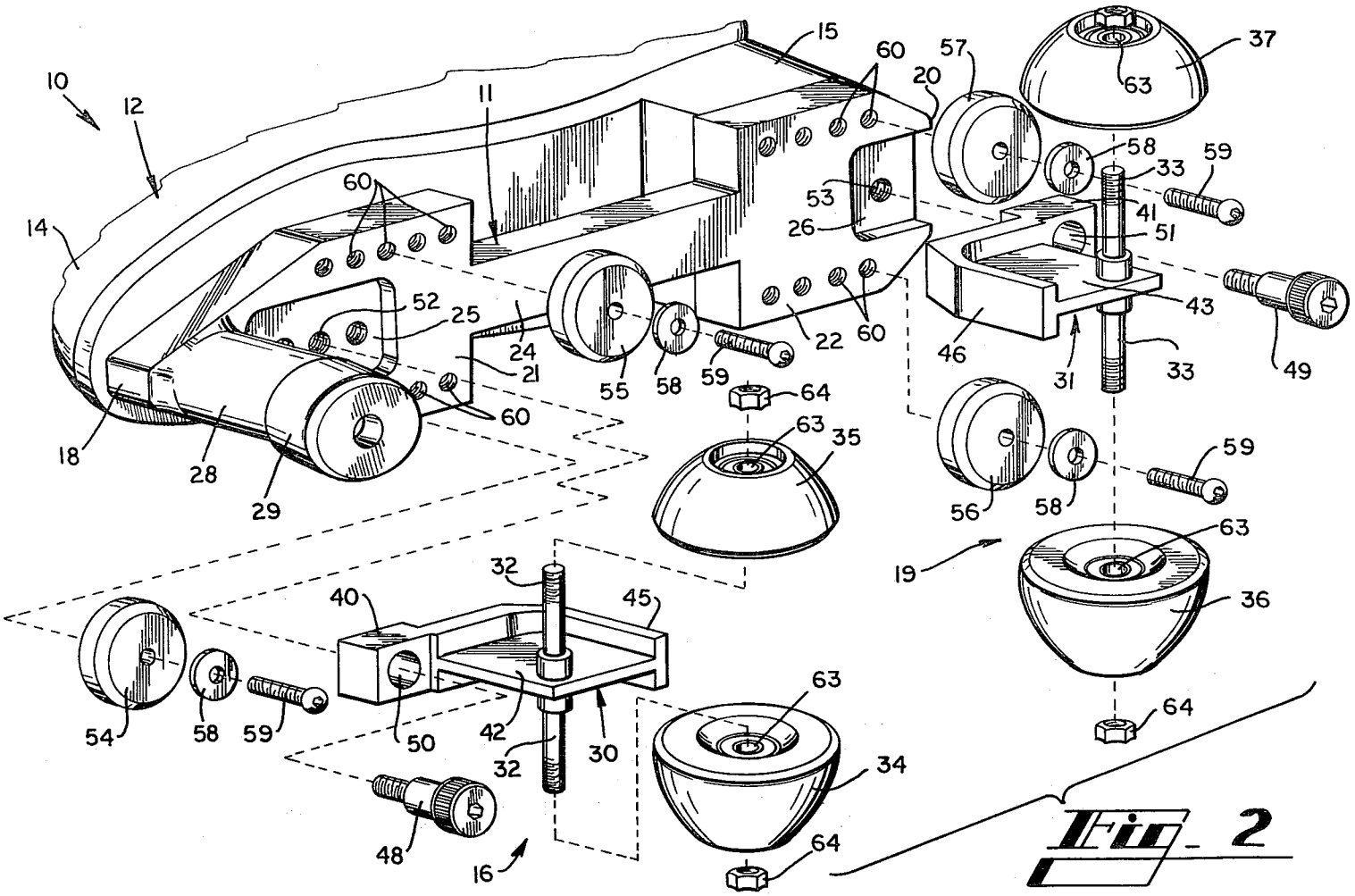
FIG. 2 is a perspective exploded illustration of the pivotable ball skate.

Referring now in more detail to the drawings, in which like numerals indicate like parts throughout the several views, FIG. 1 illustrates a pivotable ball skate 10 that includes a foot support platform 11 for supporting the foot or shoe 12 of the skater. The shoe includes a toe portion 14 and a heel portion 15. A first roller assembly 16 is mounted to the foot support platform 11 adjacent the front end 18 of the foot support platform and a rear roller assembly 19 is mounted to the foot support platform adjacent the rear end 20 of the foot support platform.

As illustrated in FIG. 2, foot support platform 11 comprises a toe portion 21, a heel portion 22 and a connecting bar 24. A recess 25 is formed in toe portion 21 and a recess 26 is formed in the heel portion 22. Skid bar 28 is rigidly attached to toe portion 21 at front end 18 and rubber tip 29 is attached to the bottom surface of skid bar 28.

Front and rear roller assemblies 16 and 19 each include a roller support bracket 30, 31, an axle 32, 33 and a pair of hemispherical rollers 34, 35, and 36, 37. Each roller support bracket 30, 31 includes a support plate 40, 41 and an axle support projection 42, 43 extending downwardly from the support plate. An arcuate flange 45, 46 extends from each support plate 40, 41 about axle support projection 42, 43. Support plates 40, 41 are of greater thickness than their respective flanges 45, 46, so that each support plate 40, 41 is mounted in its respective recess 25, 26 of the foot support platform 11 and the arcuate flange 45, 46 of each support bracket is located out of the recess 25, 26. Pivot pins 48, 49 extend through the openings 50, 51 of the respective support plate 40, 41 and are threadedly received in the internally threaded bores 52, 53 formed in the recessed portions 25, 26 of the foot support platform 11. Thus, pivot pins 48, 49 function as pivot connectors for roller support brackets 30, 31. It will be noted that the recesses 25, 26 in the foot support platform 11 are wider than the widths of support plates 40, 41 of the brackets 30, 31, so that the brackets 30, 31 can pivot with respect to the foot support platform.

Resilient pads 54, 55, 56 and 57 are mounted on foot support platform 11, with the pads 54 and 55 being positioned on opposite sides of front roller support bracket 30 and with the pads 56 and 57 being positioned on opposite sides of the rear roller support bracket 31. Screws 59 extend through washers 58 and through the openings of pads 54–57 and into the internally threaded bores 60 of the foot support platform 11 to attach the pads to the bottom surface of the foot support platform. The bores 60 are spaced along the length of the toe and heel portions 21 and 22 of the foot support platform 11 so that the resilient pads 54–57 can be located at various positions along the length of the foot support platform.

Rollers 34–37 are approximately hemispherical in shape, and each pair of rollers is mounted with their larger diameters in juxtaposition on opposite sides of the axle support projections 42 and 43 of the roller support brackets 30 and 31. The axles 32 and 33 of the roller support brackets 30 and 31 extend perpendicular to the axle support projections 42 and 43 and the axles extend through the central openings 63 of each roller 34–37. A nut 64 holds each roller on its axle. With this construction the pairs of rollers function as split balls to provide a rounded support for the skater's foot and the skater is able to lean from one side to the other (FIG. 5) when skating As illustrated in FIG. 4, when the skater has the skates oriented in an upright attitude, the weight W of the foot of the skater extends in a downward direction through the foot support platform 11, through the roller support brackets 30 and 31 through the axles 32 and 33 and then through the rollers 34–37 to the floor/ground surface 65. The resilient pads 54–57 located on opposite sides of the roller support brackets 30, 31 keep the front and rear roller assemblies 16 and 19 aligned with the length of the foot support platform 11, and as the skater moves in a forward direction the skater experiences no change in direction.

When the foot of the skater is tilted and the skater is moving in a forward direction, the weight W of the skater still acts in a vertical direction (FIG. 5), but the centrifugal forces applied to the moving skater as he makes a turn together with his weight results in a weight component W′ which approximately is directed perpendicular to the axis of rotation 66 of the rollers. If the ground surface 65 was also tilted at an angle corresponding to the tilt of the skate no pivoting of the roller support brackets 30 and 31 would occur; however, the support S shifts from the larger diameter portions of both the rollers 34–37 (FIG. 4) to one side of one of each pair of rollers such as to rollers 35 and 37 when the skates are in a right hand tilt (FIG. 5). The offset position of support S tends to pivot the roller assemblies 16 and 19 about their pivot pins 48 and 49, causing the skate to track toward its direction of tilt. The resilient pads 55 and 57 on the other side of the front and rear roller assemblies 16 and 19 tend to resist the pivoting of the roller support brackets 30 and 31, so that only a limited amount of pivoting occurs.

The resilient pads 54–57 can be mounted to the foot support platform 11 at any one of the threaded bores 60. Thus, when the resilient pads 54–57 are located in those threaded bores 60 that are furthest away from the threaded bores 52, 53 into which the pivot pins 48, 49 are threaded, a longer lever arm is provided between the point of engagement of the resilient pads 54–57 and the threaded bores 52, 53 and their pivot pins 48, 49. This results in more resistance to pivoting of the front and rear roller assemblies 16 and 19. Also, washers 58 are made of steel, and washers of different diameter can be used to bear against the resilient pads 54–57, thus applying more or less rigidity to the pads 54–57.

With this arrangement, more or less resistance can be applied to the roller support brackets 30, 31 by the resilient pads 54–57, thereby changing the performance characteristics of the skate. For example, a heavy skater may wish to move the resilient pads 54–57 far away from the pivot pins 48, 49 to compensate for the additional weight he applies to the front and rear roller assemblies 16 and 19 during a turn. Also, some skaters may prefer to have their roller assemblies 16 and 19 function substantially without any change of direction in response to tilting the foot support platform 11. If so, movement of the resilient pads 54–57 further away from the pivot pins, and use of larger diameter washers 58 would usually result in this desired performance characteristic. Other skaters may wish to have more pivoting in the front roller assembly 16 than in the rear roller assembly 19, whereupon the front roller assembly would be adjusted to have its resilient pads 54, 55 moved closer to the pivot pin 48 while the resilient pads 56, 57 would be moved further away from the pivot pin 49 at the rear of the skate. If no pivoting of the rear roller assembly is desired, rigid washers of a diameter the same as the pads 56 and 57 can be used in abutment with the pads to lock the rear roller assembly in alignment with the foot support platform.

While the drawing illustrates the foot support platform as including a rigid connecting bar 24 between its toe and heel portions 21 and 22, it should be understood that the foot support platform can be constructed to be adjustable in length as by having the connecting bar of sliding telescopic construction. Also, while the resilient pads 54–57 are illustrated as being annular, other shapes can be used and the material of the pads can be varied to provide varying skate performance.

It should be understood, of course, that the foregoing relates only to a preferred embodiment of the present invention and that numerous modifications or alterations may be made therein without departing from the spirit and the scope of the invention as set forth in the appended claims.

We claim:

1. A roller skate comprising an elongated foot support platform having a front end and a rear end for mounting against the bottom surface of a shoe or the like with its front end adjacent the toe of the shoe and the rear end adjacent the heel of the shoe, a front roller assembly mounted to said foot support platform adjacent the front end of said foot support platform, a rear roller assembly mounted to said foot support platform adjacent the rear end of said foot support platform, at least said front roller assembly comprising a roller support bracket including a support plate portion in abutment with the foot support platform and an axle support projection extending from said support plate, an axle extending outwardly to opposite sides of said axle support projection and rollers mounted on said axle with one roller on each end of said axle, said rollers each being approximately of similar size and hemispherical in shape with their larger diameters positioned in juxtaposition with respect to said support projection, a pivot connector pivotally connecting said support plate portion of said roller support bracket to said foot support platform at a position of said support plate which is longitudinally offset from said axle so that when a lateral force is applied to said rollers the rollers tend to pivot about said pivot connector out of alignment with said foot support platform, and restraining means comprising a resilient pad positioned on each side of said roller support bracket and attached to said foot support platform, said resilient pads being offset longitudinally along the length of said foot support platform with respect to said pivot connector for resiliently maintaining said rollers in alignment with said foot support platform, and means for connecting said resilient pads to said foot support platform at a multiple number of positions along the length of said foot support platform.

2. The roller skate of claim 1 and wherein said foot support platform comprises a recess in its bottom surface, and wherein said pivot connector of the roller support bracket is connected to said foot support platform in said recess.

3. The roller skate of claim 1 and wherein the front roller assembly is mounted to said foot support platform with its pivot connector positioned longitudinally in front of its rollers, and wherein the rear roller assembly is mounted to said foot support platform with its pivot connector positioned longitudinally behind its rollers.

4. A roller skate comprising an elongated foot support platform having a front end and a rear end for mounting against the bottom surface of a shoe or the like with its front end adjacent the toe of the shoe and the rear end adjacent the heel of the shoe, front and rear roller assemblies each mounted to said foot support platform adjacent the front end and rear end thereof respectively, said front and rear roller assemblies each including a support bracket and a pair of hemispherical rollers rotatably mounted on said support bracket with their larger diameters positioned adjacent each other and with their axes of rotation extending transverse to the length of said foot support platform, a pivot connector pivotally connecting each said support bracket to said foot support platform with the pivot connector of the front roller assembly connecting the support bracket of said front roller assembly at a position on its support bracket longitudinally offset ahead of the axes of rotation of its rollers and with the pivot connector of the rear roller assembly connecting the support bracket of said rear roller assembly at a position on its support bracket longitudinally offset behind the axes of rotation of its rollers, resilient pads connected to said foot support platform and positioned on opposite sides of both of said support brackets for restraining the pivotal movement of said front and rear roller assemblies out of alignment with each other, and means for mounting said resilient pads at different positions along the length of said foot support platform.

5. A roller skate comprising an elongated foot support platform having a front end and a rear end for mounting against the bottom surface of a shoe or the like with its front end adjacent the toe of the shoe and the rear end adjacent the heel of the shoe, a front roller assembly mounted to said foot support platform adjacent the front end of said foot support platform, a rear roller assembly mounted to said foot support platform adjacent the rear end of said foot support platform, at least said front roller assembly comprising a roller support bracket including a support plate portion in abutment with the foot support platform and an axle support projection extending from said support plate, an axle extending outwardly to opposite sides of said axle support projection and rollers mounted on said axle with one roller at each end of said axle, said rollers each being approximately of similar size and hemispherical in shape with their larger diameters positioned in juxtaposition with respect to said axle support projection, a pivot connector pivotally connecting said support plate portion of said roller support bracket to said foot support platform at a position on said support plate which is longitudinally offset from said axle so that when a lateral force is applied to said rollers the rollers tend to pivot about said pivot connector out of alignment with said foot support platform, and restraining means positioned on opposite sides of said roller support bracket for resiliently maintaining said rollers in alignment with said foot support platform, and means for repositioning said restraining means along the length of said roller support bracket.

* * * * *